US006825602B2

(12) United States Patent
Lee

(10) Patent No.: US 6,825,602 B2
(45) Date of Patent: Nov. 30, 2004

(54) DEFLECTION YOKE FOR CATHODE RAY TUBE

(75) Inventor: Seok Moon Lee, Gumi-si (KR)

(73) Assignee: LG. Philips Displays Korea Co., Ltd., Gyeongsangbuk-do (KR)

( * ) Notice: Subject to any disclaimer, the term of this patent is extended or adjusted under 35 U.S.C. 154(b) by 0 days.

(21) Appl. No.: 10/340,593

(22) Filed: Jan. 13, 2003

(65) Prior Publication Data

US 2003/0209967 A1 Nov. 13, 2003

(30) Foreign Application Priority Data

May 7, 2002 (KR) ..... 2002-24939

(51) Int. Cl.[7] ..... H01J 29/70
(52) U.S. Cl. ..... 313/440; 335/213
(58) Field of Search ..... 313/440; 335/210–213

(56) References Cited

U.S. PATENT DOCUMENTS 5,099,169 A 3/1992 Vriens
5,962,964 A 10/1999 Sano et al.
6,166,484 A * 12/2000 Okuyama et al. ..... 313/440
6,670,746 B2 * 12/2003 Gorog ..... 313/477 HC

FOREIGN PATENT DOCUMENTS

JP 61-22542 A 1/1986
JP 7-192654 A 7/1995

* cited by examiner

*Primary Examiner*—Joseph Williams
(74) *Attorney, Agent, or Firm*—Birch, Stewart, Kolasch & Birch, LLP

(57) ABSTRACT

The present invention discloses a cathode ray tube including a deflection yoke which can remarkably decrease a leakage magnetic field. In the deflection yoke, a diameter of an end of a ferrite core to a screen side is 50% to 85% of a diameter of an end of a horizontal deflection coil to the screen side, and an interval between the end of the horizontal deflection coil to the screen side and the end of the ferrite core to the screen side is 27% to 50% of a length of the horizontal deflection coil in a tube axis direction. As a result, the cathode ray tube can overcome problems of general cancel coils, and reduce the leakage magnetic field even at a high deflection angle.

10 Claims, 12 Drawing Sheets

DEFLECTION YOKE FOR CATHODE RAY TUBE

BACKGROUND OF THE INVENTION

This nonprovisional application claims priority under 35 U.S.C. §119(a) on patent application Ser. No. 2002-0024939 filed in KOREA on May 7, 2002, which is herein incorporated by reference.

1. Field of the Invention

The present invention relates to a cathode ray tube, and more particularly, to a cathode ray tube having a deflection yoke which can decrease a leakage magnetic field.

2. Description of the Related Art

In general, a television set or other image display devices using a cathode ray tube include a deflection yoke for deflecting an electron beam generated from an electron gun.

Here, a black and white cathode ray tube needs one electron gun, but a color cathode ray tube includes three in-line electron guns aligned in a row on a horizontal surface in order to reproduce color images with the mixture of red R, green G and blue B.

The color cathode ray tube employs a self-converging deflection yoke using an irregular magnetic field so as to converge three electron beams R, G and B emitted from the in-line electron guns into one point of a phosphor screen.

Here, the three electron beams emitted from the electron guns are deflected in a horizontal or vertical direction by a pincushion type horizontal deflection magnetic field or a barrel type vertical deflection magnetic field of the deflection yoke.

The beams deflected by the deflection yoke can be landed on the phosphor screen through a shadow mask.

FIG. 1 is a structure view illustrating a general cathode ray tube. Referring to FIG. 1, the cathode ray tube includes a panel unit 1, a funnel unit 2 connected to the panel unit 1, and a neck side 3 incorporating with the funnel unit 2.

A phosphor screen 5 coated with three dot or stripe-shaped color phosphor layers emitting R, G and B lights is installed on the inner surface of a panel 4 of the panel unit 1. In addition, a shadow mask 6 which is a color sorting electrode having a plurality of pores or slits is aligned at the inside portion to face the phosphor screen 5. The shadow mask 6 is connected to a frame 7, elastically supported by an elastic member 8, and also supported by the panel 4 through a stud pin 9. An inner shield 10 is fixed to the frame 7 in order to intercept an external magnetic field of electron beams deflected by a deflection yoke 13 to prevent the path of the electron beams from being changed.

Electron guns 14 are built in the neck side 3 for receiving a voltage and emitting R, G and B electron beams. Preferably, the electron guns 14 are in-line type electron guns aligned in a row on the same plane in the color cathode ray tube, for emitting three electron beams. In addition, convergence purity correction magnets (CPM) for converging the electron beams 12 emitted from the electron guns 14 into one point are positioned at the front end of the electron guns 14.

The deflection yoke 13 for horizontally or vertically deflecting the electron beams from the electron guns 14 is disposed on the outer surface of the funnel unit 2 at the rear end of the funnel unit 2, namely the front end of the neck side 3.

As illustrated in FIG. 2, the deflection yoke 13 includes a round-shaped holder 35 for forming a first flange 25 and a second flange 27 comprising a screen side 21 and a neck side 23, fixing horizontal deflection coils 29*a* and 29*b*, a vertical deflection coil 31 and a ferrite core 33 to predetermined positions, and insulating the vertical deflection coil 31 and the horizontal deflection coils 29*a* and 29*b*, the horizontal deflection coils 29*a* and 29*b* wound between the first flange 25 and the second flange 27 at the inside portion of the holder 35, for deflecting the electron beams emitted from the electron guns in the horizontal direction, the vertical deflection coil 31 wound between the first flange 25 and the second flange 27 at the inside portion of the holder 35, for deflecting the electron beams in the vertical direction, and the conical ferrite core 33 for improving magnetic efficiency by decreasing loss of the horizontal/vertical deflection magnetic field generated by the horizontal deflection coils 29*a* and 29*b* and the vertical deflection coil 31.

In general, the deflection yoke 13 generates the leakage magnetic field in the screen side 21 and the neck side 23. The leakage of the magnetic field is harmful to humans.

In order to prevent leakage of the magnetic field, cancel coils 37*a* and 37*b* are installed at the upper and lower portions of the first flange 25 of the deflection yoke 13. Here, a fetch line 41 fetched from a terminal plate 39 is connected to the horizontal deflection coils 29*a* and 29*b* through the cancel coils 37*a* and 37*b*.

As shown in FIG. 4, the upper horizontal deflection coil 29*a* is connected in series to the pair of cancel coils 37*a* and 37*b*, and the lower horizontal deflection coil 29*b* is connected in series to a resistor R and a condenser C, which are re-connected in parallel. A saw tooth wave horizontal deflection current is applied to both ends H+ and H−, thereby generating the horizontal deflection magnetic field. Accordingly, the electron beams emitted from the electron gun are horizontally deflected due to the horizontal deflection magnetic field.

In general, the conventional deflection yoke applies a current having a frequency of at least 15.76 kHz to both ends H+ and H− of the horizontal deflection coils 29*a* and 29*b*, and deflects the electron beams of the funnel unit 2 in the horizontal direction by using the thusly-generated pincushion type horizontal deflection magnetic field. On the other hand, the deflection yoke applies a current having a frequency of about 60 Hz to the vertical deflection coil 31, and deflects the electron beams in the vertical direction by using the thusly-generated barrel type vertical deflection magnetic field.

In addition, the self-converging type deflection yoke has been developed to converge the three electron beams onto the screen by using an irregular magnetic field due to the horizontal deflection coils 29*a* and 29*b* and the vertical deflection coil 31, without requiring a special additional circuit or device.

That is, the self-converging type deflection yoke adjusts the wiring distribution of the vertical deflection coil 31 and the horizontal deflection coils 29*a* and 29*b*, generates the barrel or pincushion type magnetic field to each portion, (for example the screen side 21, intermediate side 22 and neck side 23) in order for the three electron beams to have deflection force that differs according to their positions, and converges the electron beams to the same point in spite of a different distance between a starting point and ending point (namely, phosphor screen), thereby precisely hitting the corresponding phosphors.

In the case that the horizontal deflection magnetic field and the vertical deflection magnetic field are generated by transmitting the current to the horizontal deflection coils 29*a* and 29*b* and the vertical deflection coil 31, the horizontal/vertical deflection magnetic fields generated due to the horizontal/vertical deflection coils, it is difficult to deflect the electron beams toward the whole surface of the panel. Therefore, the ferrite core 33 of high magnetic permeability is used to minimize loss on a feedback path of the magnetic fields, thereby increasing magnetic efficiency and magnetic force.

On the other hand, as described above, the screen side 21 and the neck side 23 of the deflection yoke unnecessarily generates the leakage magnetic field in addition to the main deflection magnetic field for deflecting the electron beams in the horizontal or vertical direction. The leakage magnetic field may be harmful to humans. Particularly, leakage magnetic fields having extremely low frequencies (ELF) ranging from 5 Hz to 2 kHz or a very low frequency (VLF) ranging from 2 to 400 kHz are considerably harmful to humans. Therefore, a means for solving this problem is necessary.

One of the areas of research called for decreasing a length of an electric field, wherein a diameter and a slope angle of an end to the screen side in the deflection yoke are increased to obtain a high deflection angle, to remarkably generate the leakage magnetic field.

Also, a method for using the cancel coils 37*a* and 37*b* positioned at the upper and lower portions of the first flange 25 of the holder 35 as the means for decreasing the leakage magnetic field, or a method for increasing an interval between the end of the ferrite core to the screen side and the end of the horizontal deflection coil to the screen side has been employed.

FIG. 2 is a view illustrating the method for decreasing the leakage magnetic field by using the cancel coils, and FIG. 3 is a schematic cross-sectional view illustrating the deflection yoke using the cancel coils. As depicted in FIG. 3, since an unnecessary leakage magnetic field 45 is generated in the screen side (s) and neck side (n) of the deflection yoke in addition to a main deflection magnetic field 43 for deflecting the electron beams in the horizontal or vertical direction, the pair of cancel coils 37*a* and 37*b* are disposed at the upper and lower portions of the first flange 25 of the holder 35, so that a cancel magnetic filed 47 generated from the cancel coils 37*a* and 37*b* can offset the leakage magnetic field 45. Referring to FIG. 4, the cancel coils 37*a* and 37*b* are wired in a horizontal deflection circuit. The leakage magnetic field 45 generated in the screen side (s) of the horizontal deflection coils 29*a* and 29*b* and the cancel magnetic field generated due to the cancel current flowing through the cancel coils 37*a* and 37*b* have opposite directions to offset the leakage magnetic field.

However, the conventional deflection yoke has the following disadvantages:

First, as shown in the wiring circuit of FIG. 4, an inductance value of the cancel coils 37*a* and 37*b* is added in series to an inductance value of the horizontal deflection coils 29*a* and 29*b*, and thus the inductance value of the horizontal deflection coils 29*a* and 29*b* must be decreased to maintain the identical inductance value. When the inductance value of the horizontal deflection coils 29*a* and 29*b* is decreased, horizontal deflection sensitivity is reduced. In addition, reduction of the horizontal deflection sensitivity results in reduction of screen size. In order to obtain a screen size identical to the size before reduction of the sensitivity, the horizontal deflection current transmitted to the horizontal deflection coils must be increased. However, increase of the horizontal deflection current deteriorates a heat generation property of the deflection yoke, thus reducing the quality of the deflection yoke.

Secondly, when the cancel coils are used to decrease the leakage magnetic field, the cancel coils generate ringing 49 on a screen 48 as shown in FIG. 5. That is, the charged current is discharged due to stray capacitance between the coils wound around the pair of cancel coils 37*a* and 37*b* in a feedback time of the horizontal deflection current, thereby generating the ringing 49 at the left side of the screen 48. In order to remove the ringing, the resistor R and the condenser C are connected to the horizontal deflection coils 29*a* and 29*b* as shown in FIG. 4. However, the aforementioned method increases the price of the deflection yoke and complicates the operation for installing the components such as the resistor and the condenser on a printed circuit board.

Third, when the fetch line 41 of the cancel coils 37*a* and 37*b* is connected to the horizontal deflection coils 29*a* and 29*b*, the fetch line 41 comes off. Accordingly, an insulating tube must be provided to prevent sparks between the fetch line 41 and the horizontal deflection coils 29*a* and 29*b*, and a terminal for connecting an additional fetch line must be inserted into the terminal plate 39 for connection to the horizontal deflection coils 29*a* and 29*b*. As a result, the number of the required operations is increased to thereby reduce efficiency and productivity.

Fourth, the cancel coils 37*a* and 37*b* must be prepared and installed. That is, the cancel coils 37*a* and 37*b* are wound and installed by using a bobbin formed with an injection material. Thus, the injection type cancel coil bobbin must be individually produced. Since the cancel coil bobbin is individually produced, a mold needs to be produced (thus incurring additional expenses). In addition, specifications of the cancel coils are changed according to improvements of an image display device or variations of a model, and thus the cancel coil bobbin must be produced, wound and installed by using a new mold.

On the other hand, when the method for increasing the interval between the end of the ferrite core to the screen side and the end of the horizontal deflection coil to the screen side is used to reduce the leakage magnetic field, the application range of the interval is extremely narrow. Moreover, a high deflection angle greater than 100° remarkably increases the leakage magnetic field. Therefore, the interval is not sufficient to offset the leakage magnetic field.

Recently, research for embodying a cathode ray tube with a reduced electric field have been actively conducted. It has been considered that, to reduce the electric field of the cathode ray tube, the deflection yoke is required to have a high deflection angle (greater than 110° in monitor). However, the increased deflection angle reduces the deflection sensitivity of the deflection yoke, and remarkably increases the leakage magnetic field of the horizontal deflection coils. To solve the foregoing problem, a rectangular cone (RAC) deflection yoke has been suggested. The RAC deflection yoke obtains the stable deflection sensitivity at the high deflection angle, but fails to improve the leakage magnetic field property as follows:

The horizontal deflection magnetic field generated in the horizontal deflection coil consists of combinations of the magnetic field generated in the horizontal deflection coil itself and the magnetic field generated due to magnetization of the ferrite core by the magnetic field generated by the horizontal deflection coil. Particularly, the magnetic field generated by the ferrite core is incident on the inner surface of the ferrite core, transferred through a body of the ferrite core, and discharged vertically to the inner surface of the ferrite core. Accordingly, the leakage magnetic field generated through the screen side of the horizontal deflection coil is increased or decreased sensitively to the slope angle or diameter of the inner surface of the ferrite core. However, when the deflection angle of the deflection yoke is increased to obtain a high deflection angle, the diameter of the inner surface of the ferrite core for the deflection yoke is remarkably increased to generate the leakage magnetic field. Therefore, it is very difficult to decrease the leakage magnetic field at the high deflection angle.

In general, in order to measure the leakage magnetic field, a measuring device is installed separately from the panel of the cathode ray tube by 500 mm. According to the international specifications, when the current having a frequency of 15.75 kHz is transmitted, the leakage magnetic field is generally generated below 25 nT.

However, the distance between the deflection yoke and the measuring device is decreased due to reduction of the electric field. The leakage magnetic field is inversely proportional to the distance, and thus considerably increased. For example, in the case of the deflection yoke having a deflection angle greater than 110°, the leakage magnetic field ranges from 80 to 100 nT.

As described above, it is very difficult to reduce the leakage magnetic field both in the general deflection yoke and the deflection yoke for obtaining the high deflection angle.

SUMMARY OF THE INVENTION

An object of the invention is to solve at least the above problems and/or disadvantages and to provide at least the advantages described hereinafter.

Accordingly, one object of the present invention is to provide a cathode ray tube having a deflection yoke which can efficiently decrease a leakage magnetic field without using special auxiliary means, for example cancel coils.

It is another object of the present invention to provide a cathode ray tube having a deflection yoke which can overcome reduction of horizontal deflection sensitivity and deterioration of a heat generation property of the deflection yoke due to cancel coils.

It is yet another object of the present invention to provide a cathode ray tube having a deflection yoke which can decrease a leakage magnetic field generated by a ferrite core at a high deflection angle.

These and other objects and advantages of the invention are achieved by providing a cathode ray tube wherein, in a deflection yoke, a diameter of an end of a ferrite core to a screen side is 50% to 85% of a diameter of an end of a horizontal deflection coil to a screen side, and an interval between the end of the horizontal deflection coil to the screen side and the end of the ferrite core to the screen side is 27% to 505 of a length of the horizontal deflection coil in a tube axis direction. The cathode ray tube has a deflection angle greater than 110°.

According to another aspect of the invention, there is provided a TPS type cathode ray tube wherein, in a deflection yoke, a diameter of an end of a ferrite core to a screen side is 50% to 85% of a diameter of an end of a line deflection coil to the screen side, and an interval between the end of the line deflection coil to the screen side and the end of the ferrite core to the screen side is 27% to 50% of a length of the line deflection coil in a tube axis direction.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF THE PREFERRED EMBODIMENT

The following detailed description will present a preferred embodiment of the invention in reference to the accompanying drawings.

Embodiment 1

Figure 1:
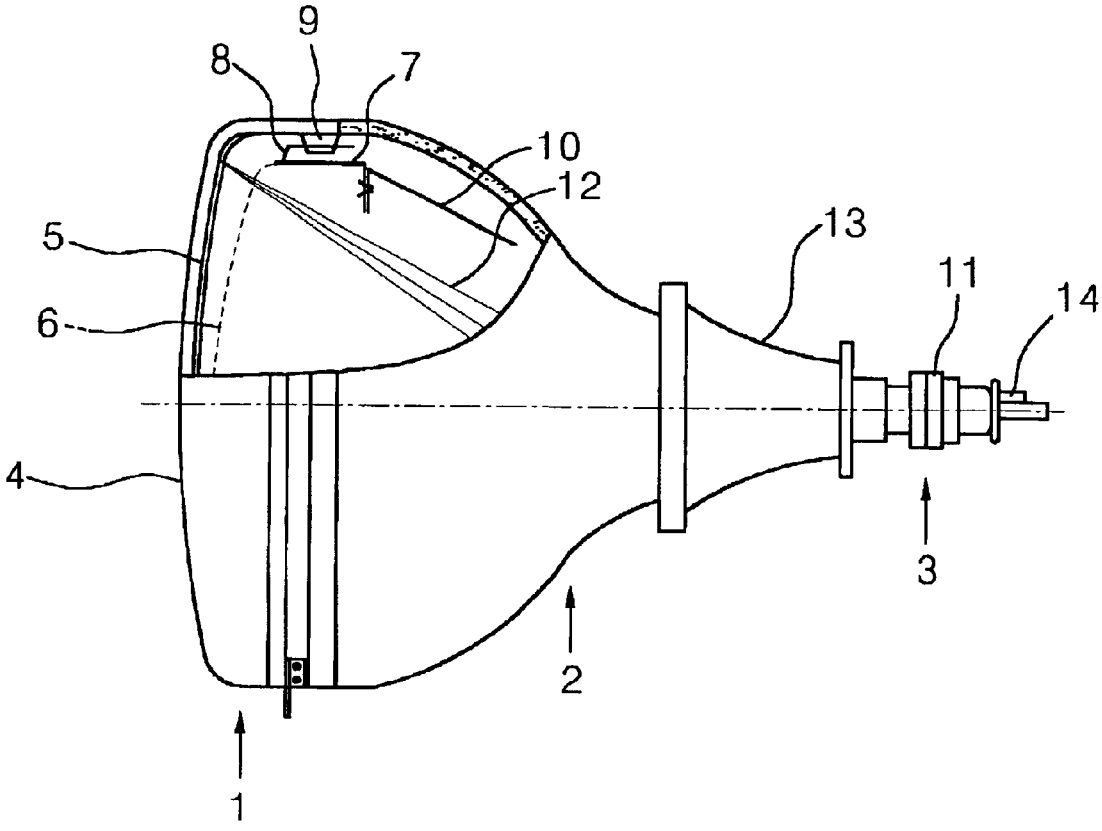
Fig. 1 (Related Art)
FIG. 1 is a structure view illustrating a general cathode ray tube.
Figure 2:
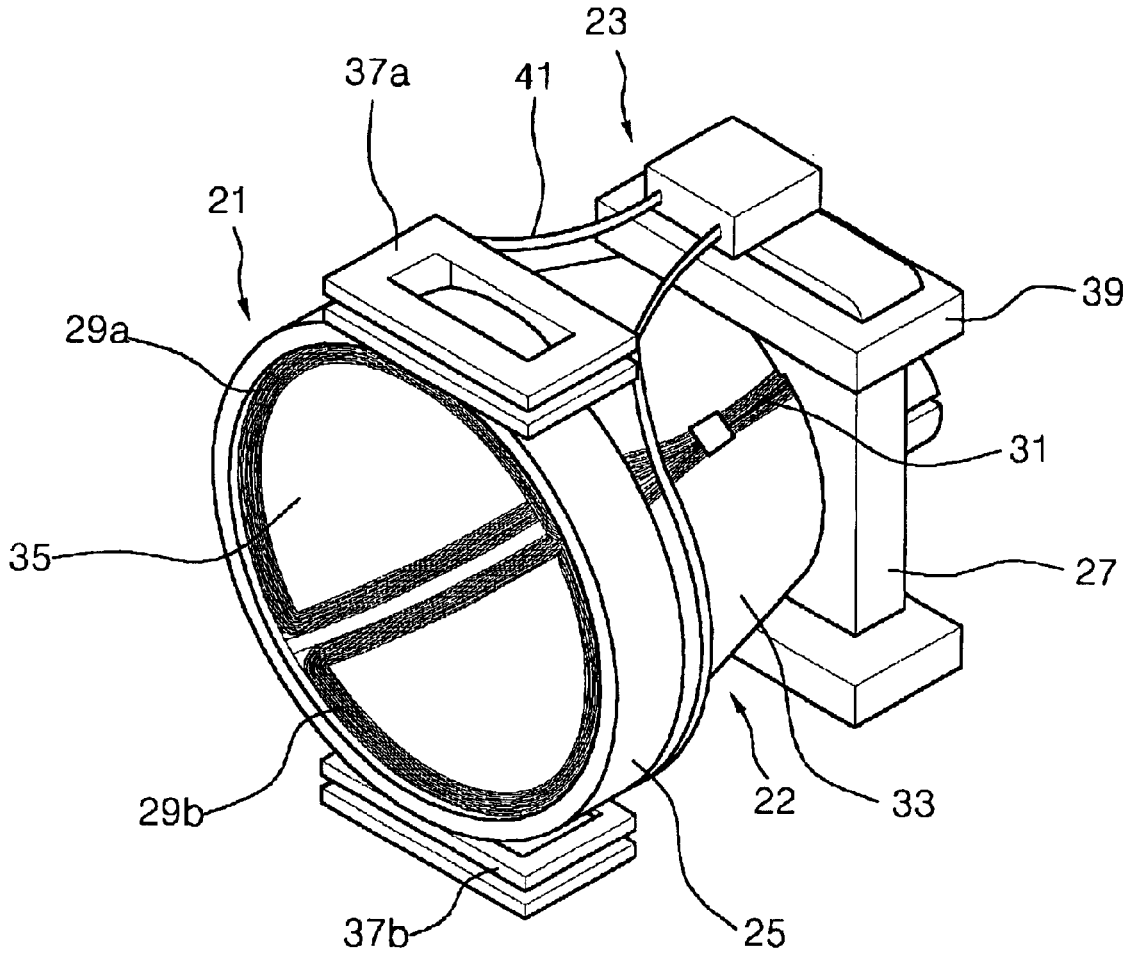
Fig. 2 (Related Art)
FIG. 2 is a structure view illustrating a conventional deflection yoke.
Figure 3:
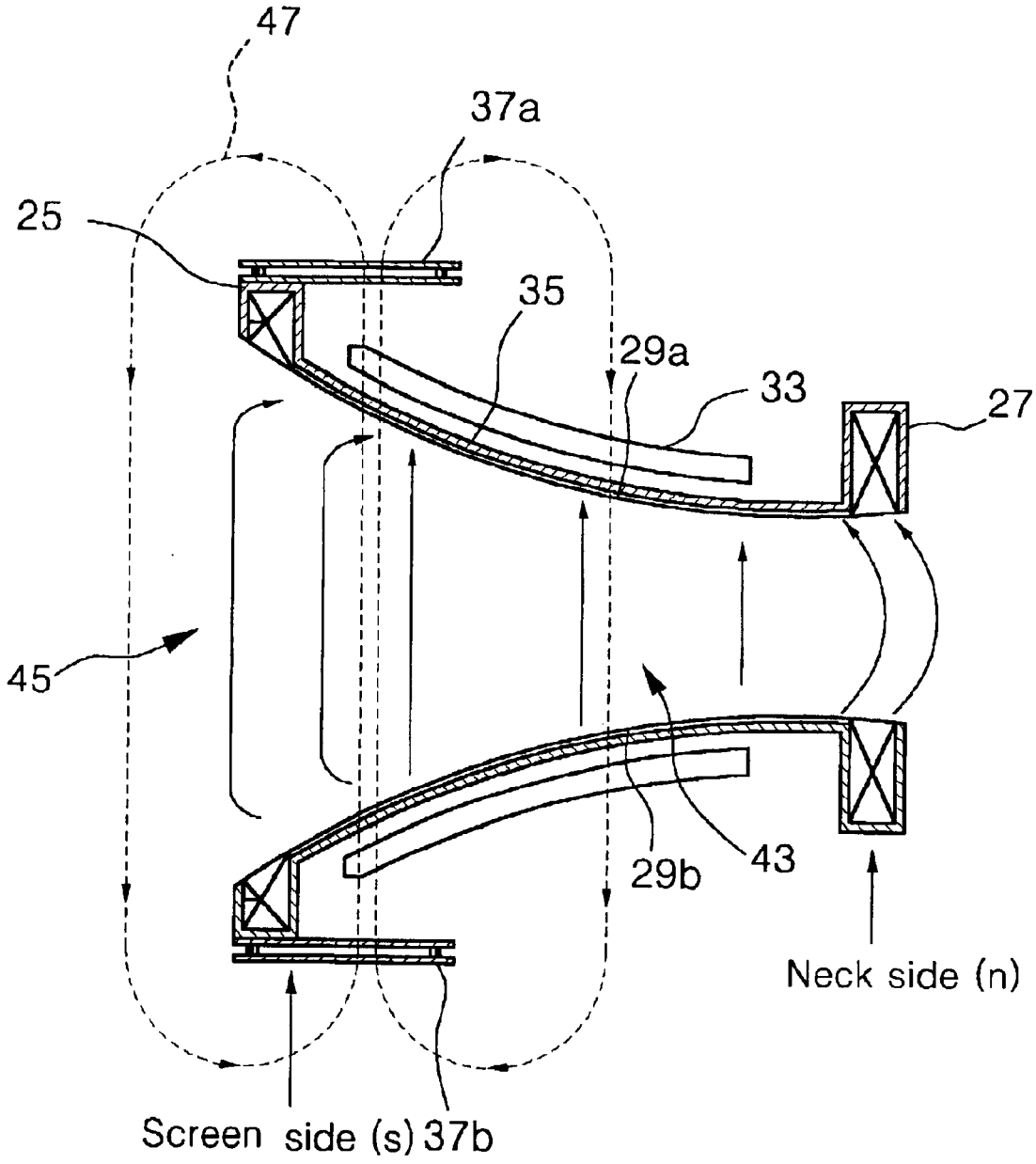
Fig. 3 (Related Art)
FIG. 3 is a view illustrating magnetic field patterns generated in the conventional deflection yoke.
Figure 4:
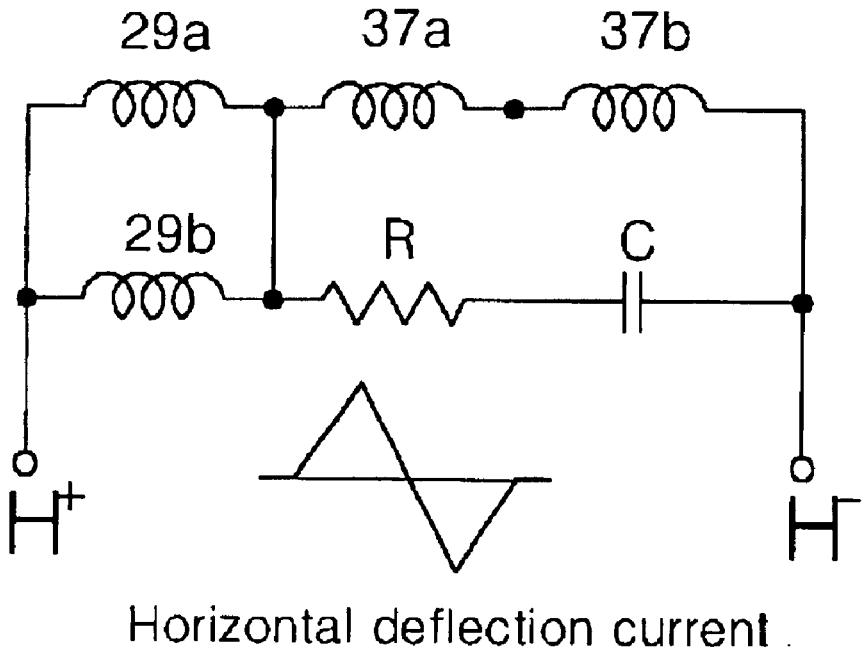
Fig. 4 (Related Art)
FIG. 4 is a circuit view illustrating horizontal deflection coils and cancel coils wired in the conventional deflection yoke.
Figure 5:
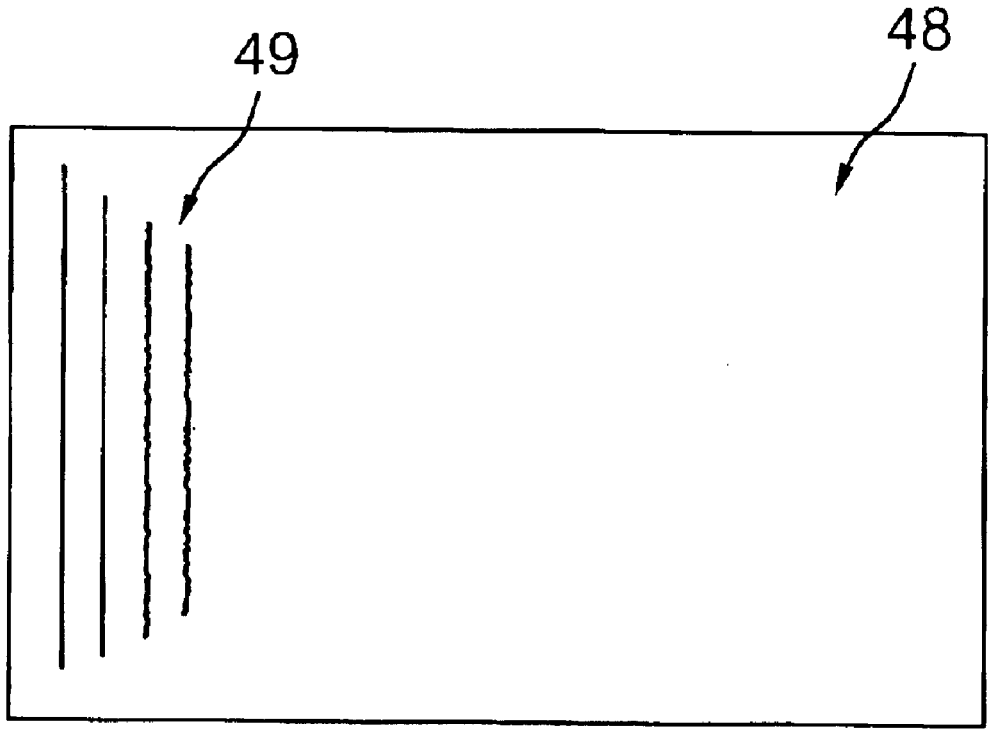
Fig. 5 (Related Art)
FIG. 5 is a view illustrating ringing generated due to the cancel coils.
Figure 6:
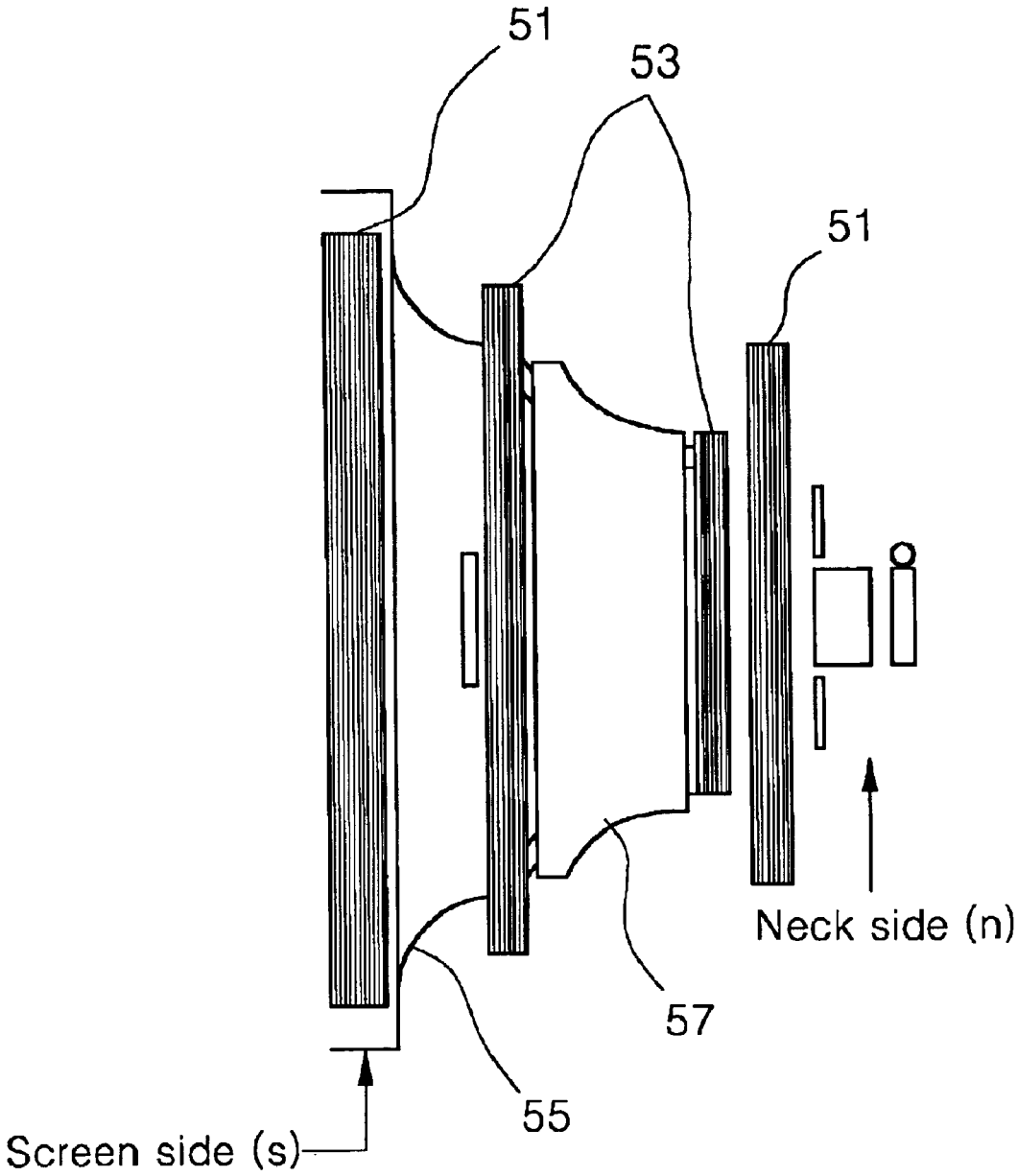
FIG. 6 is a schematic structure view illustrating a deflection yoke in accordance with the present invention.

FIG. 6 is a schematic structure view illustrating a deflection yoke in accordance with the present invention. As illustrated in FIG. 6, the deflection yoke includes a horizontal deflection coil 51 in a screen side (s), and a ferrite core 57 between the screen side (s) and a neck side (n). Here, a holder 55 for insulating the horizontal deflection coil 51 and the ferrite core 57 is provided therebetween, and a vertical deflection coil 53 is positioned between the holder 55 and the ferrite core 57. Accordingly, the alignment order of the components from the inside of the deflection yoke is the horizontal deflection coil 51, the holder 55, the vertical deflection coil 53 and the ferrite core 57. Preferably, the deflection yoke decreases a diameter of an end of the ferrite core to the screen side, and reduces a length of the ferrite core in a tube axis direction.

When the ferrite core 57 is mounted on the outer surface of the holder 55, an end of the neck side of the ferrite core is positioned as in the prior art. Since the length of the ferrite core in the tube axis direction is decreased, an interval between the end of the horizontal deflection coil to the screen side and the end of the ferrite core to the screen side is increased.

Still referring to FIG. 6, the deflection yoke does not use a special auxiliary means (for example, cancel coils in a related art) for decreasing the leakage magnetic field generated in the screen side (s). That is, the magnetic field is generated vertically to the inner surface of the ferrite core, and the leakage magnetic field is sensitive to a diameter or slope angle of the inner surface of the ferrite core, instead of using the cancel coils. Therefore, the present invention reduces the leakage magnetic field by decreasing the diameter and increasing the interval between the end of the horizontal deflection coil of the screen and the end of the ferrite core to the screen side.

Figure 7A:
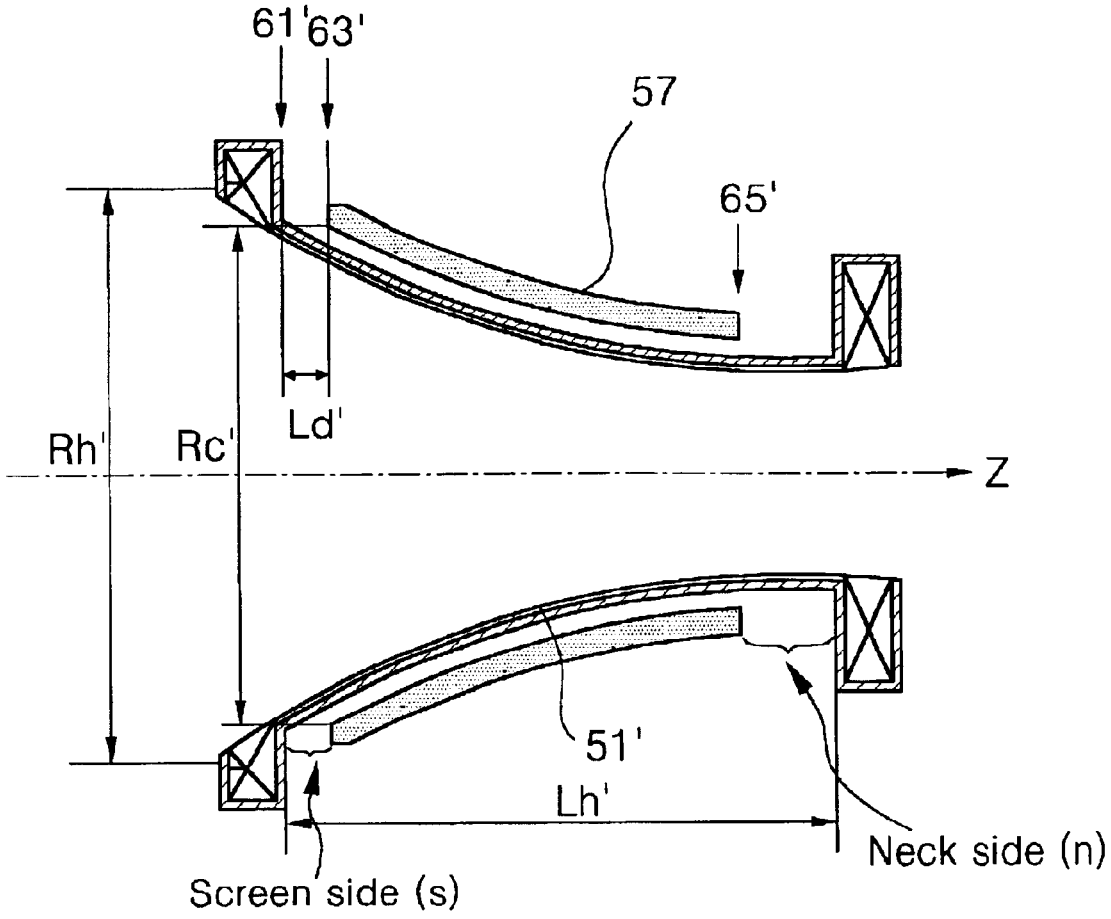
FIG. 7 is a view illustrating a position relation between a ferrite core and a horizontal deflection coil in the deflection yoke in accordance with a preferred embodiment of the present invention.
Figure 7B:
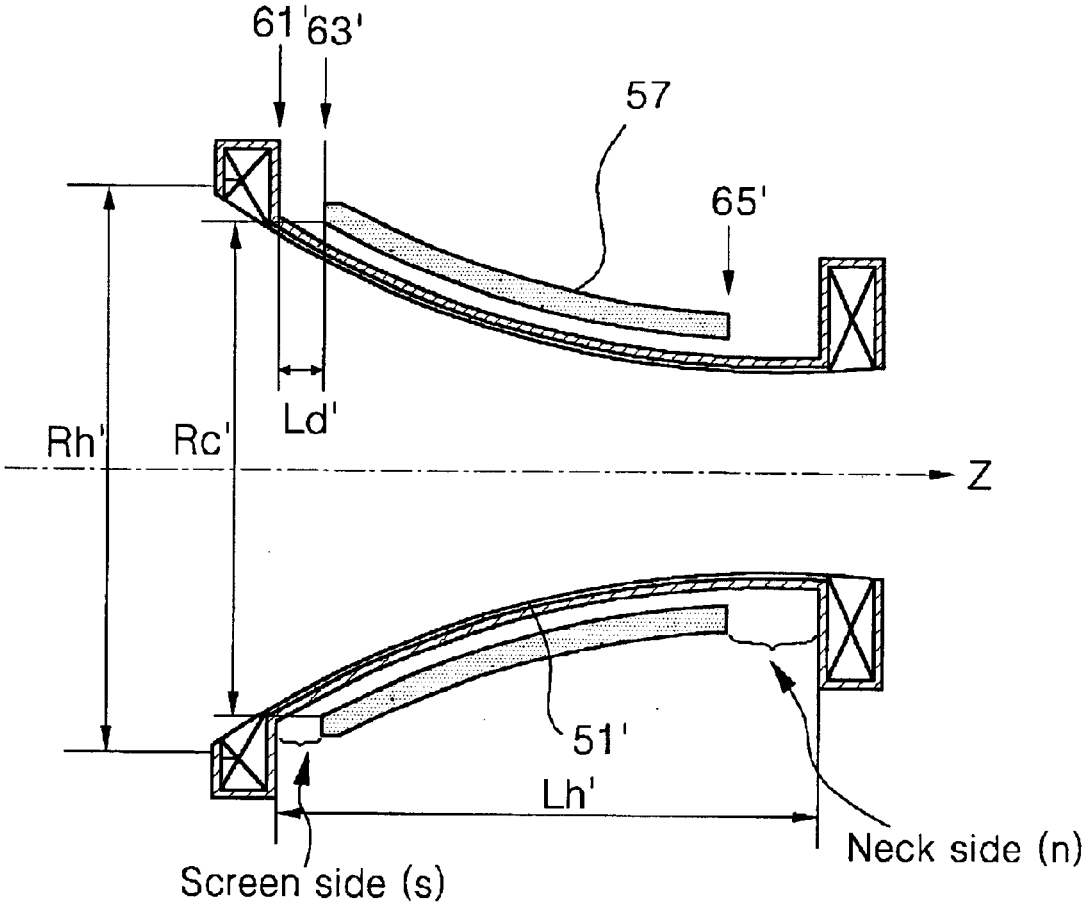

FIGS. 7A and 7B are views illustrating position relation between the ferrite core and the horizontal deflection coil in the deflection yoke in accordance with the preferred embodiment of the present invention. That is, FIG. 7A shows a position relation between the ferrite core and the horizontal deflection coil in the deflection yoke in accordance with the present invention, and FIG. 7B shows a position relation between the ferrite core and the horizontal deflection coil in the conventional deflection yoke.

Referring to FIG. 7A, in the deflection yoke, a diameter Rc of an end 63' of the ferrite core to the screen side is 50% to 85% of a diameter Rh of an end 61' of the horizontal deflection coil to the screen side, and an interval Ld between the end 61' of the horizontal deflection coil to the screen side and the end 63' of the ferrite core to the screen side is 27% to 50% of a length Lh of the horizontal deflection coil in a tube axis direction Z.

Here, it should be recognized that the diameter Rh of the end 61 of the horizontal deflection coil to the screen side is not changed as compared with the prior art. That is, the diameter Rc of the end 63 of the ferrite core to the screen side is variable. Preferably, the diameter Rc of the end 63 of the ferrite core to the screen side is decreased.

In addition, it should also be recognized that the length Lh of the horizontal deflection coil in the tube axis direction Z is not changed as compared with the prior art. That is, the interval Ld between the end 61 of the horizontal deflection coil to the screen side and the end of the ferrite core to the screen side is variable. Preferably, the interval Ld between the end 61 of the horizontal deflection coil to the screen side and the end 63 of the ferrite core to the screen side is increased.

As depicted in FIGS. 7A and 7B, the diameter Rc of the end 63' of the ferrite core to the screen side of the deflection yoke of the invention is smaller than a diameter Rc' of an end 63' of a ferrite core to a screen side of a general deflection yoke, and the interval Ld between the end 61' of the horizontal deflection coil to the screen side of the deflection yoke of the invention and the end 63' of the ferrite core to the screen side thereof is greater than an interval Ld' between an end 61' of a horizontal deflection coil to a screen side of the general deflection yoke and an end 63' of a ferrite core to the screen side thereof.

As described above, a ratio Rc/Rh of the diameter Rh of the end 61' of the horizontal deflection coil to the screen side to the diameter Rc of the end 63' of the ferrite core to the screen side and/or a ratio Ld/Lh of the length Lh of the horizontal deflection coil in the tube axis direction Z to the interval Ld between the end 61' of the horizontal deflection coil to the screen side and the end 63' of the ferrite core to the screen side is appropriately determined to remarkably reduce the leakage magnetic field to the screen side without using cancel coils.

Figure 8A:
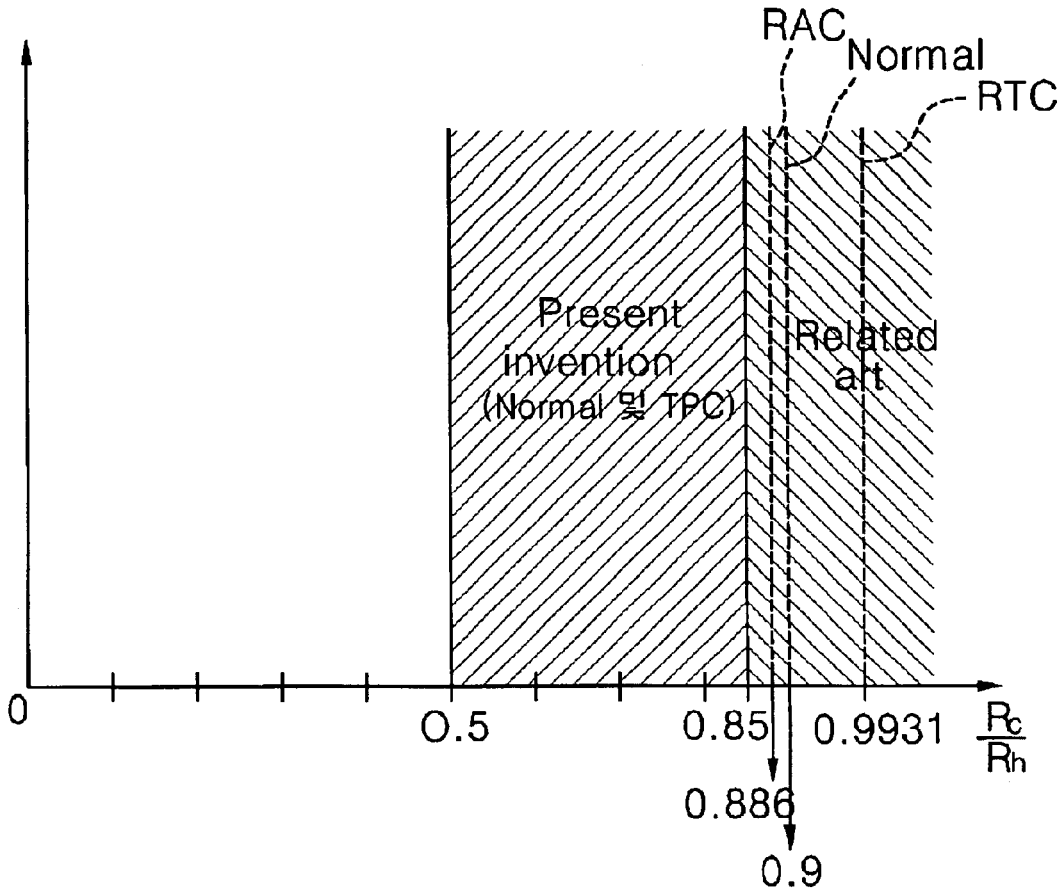
FIG. 8 is a graph showing a diameter and interval in accordance with a preferred embodiment of the present invention.
Figure 8B:
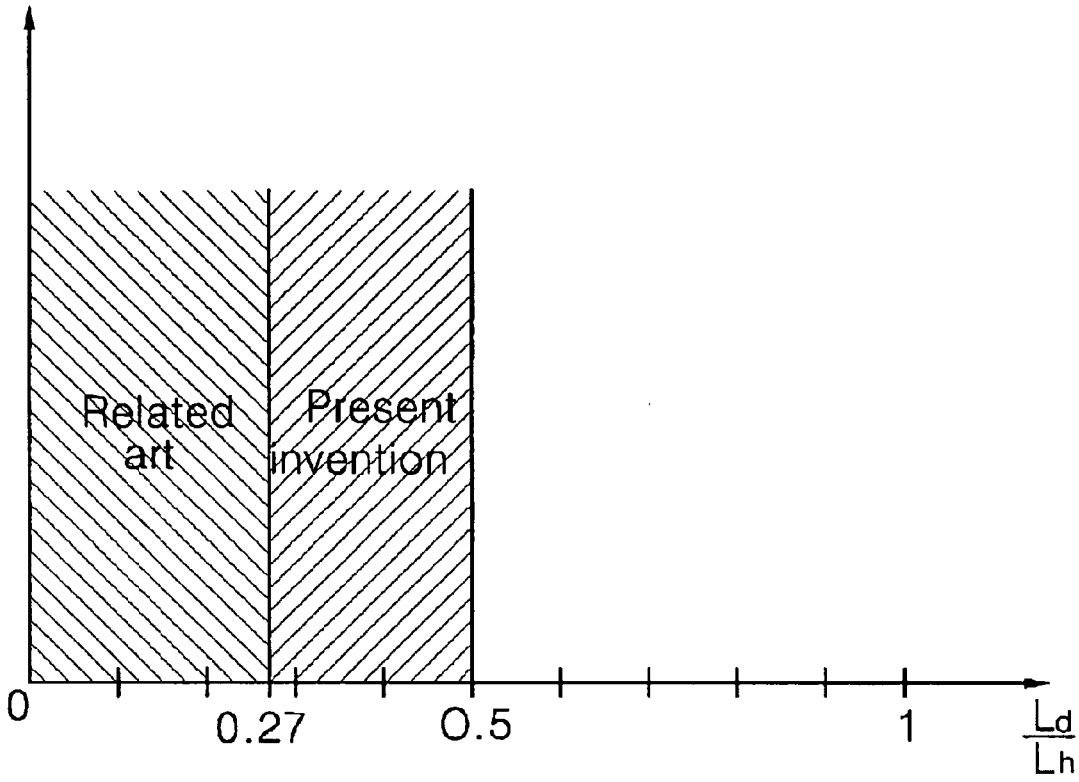

FIGS. 8A and 8B illustrate positions of the ferrite core and the horizontal deflection coil in the deflection yoke of the invention and the conventional deflection yoke. FIG. 8A shows the diameter Rc of the end of the ferrite core to the screen side, and FIG. 8B shows the interval Ld between the end of the horizontal deflection coil to the screen side and the end of the ferrite core to the screen side.

As illustrated in FIG. 8A, in the conventional deflection yoke, the ratio Rc/Rh of the diameter Rc of the end of the ferrite core to the screen side to the diameter Rh of the end of the horizontal deflection coil to the screen side is 0.886 (RAC), 0.9 (Normal) and 0.09931 (RTC) according to 15, 17 and 19 inches. However, the deflection yoke of the invention occupies the range from 0.5 to 0.85. Still referring to FIG. 8A, the deflection yoke of the invention has the smaller ratio Rc/Rh of the diameter Rc of the end of the ferrite core to the screen side to the diameter Rh of the end of the horizontal deflection coil to the screen side than the conventional deflection yoke. It implies that the diameter Rc of the end of the ferrite core to the screen side is smaller than the conventional one.

As shown in FIG. 8B, the deflection yoke of the invention increases the ratio Ld/Lh of the length Lh of the horizontal deflection coil in the tube axis direction Z to the interval Ld between the end of the horizontal deflection coil to the screen side and the end of the ferrite core to the screen side more than the conventional deflection yoke. It implies that the deflection yoke of the invention increases the interval Ld between the end of the horizontal deflection coil to the screen side and the end of the ferrite core to the screen side.

As described above, the deflection yoke of the present invention decreases the diameter of the end of the ferrite core to the screen side, and simultaneously increases the interval between the end of the horizontal deflection coil to the screen side and the end of the ferrite core to the screen side.

Figure 9A:
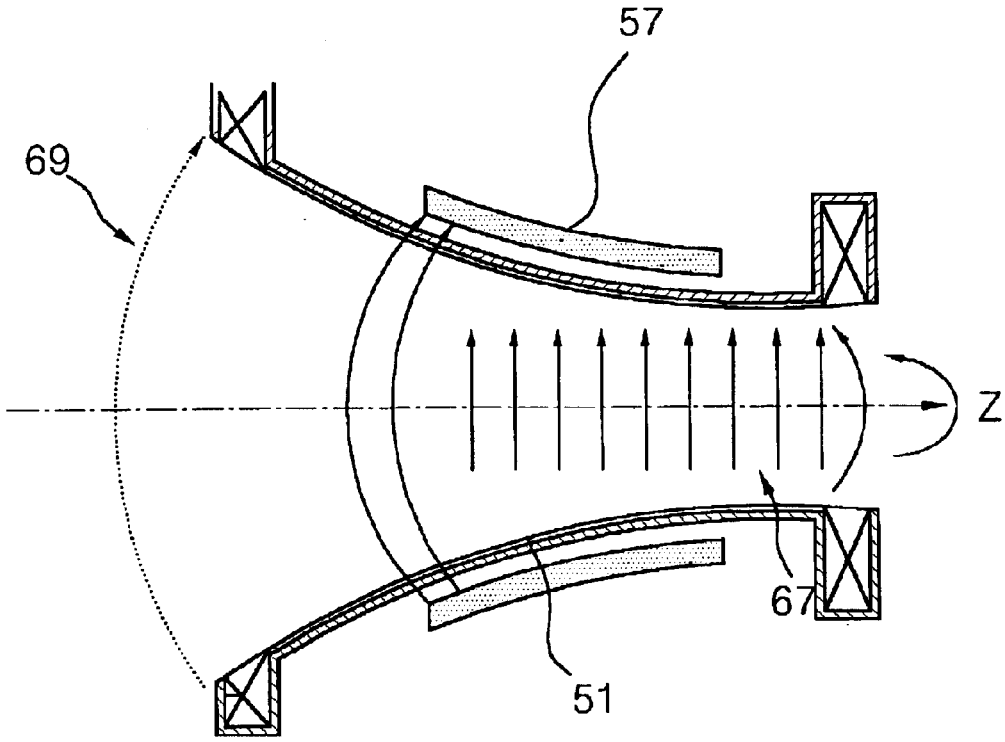
FIG. 9 is a view illustrating magnetic field patterns generated in the deflection yoke in accordance with a preferred embodiment of the present invention.
Figure 9B:
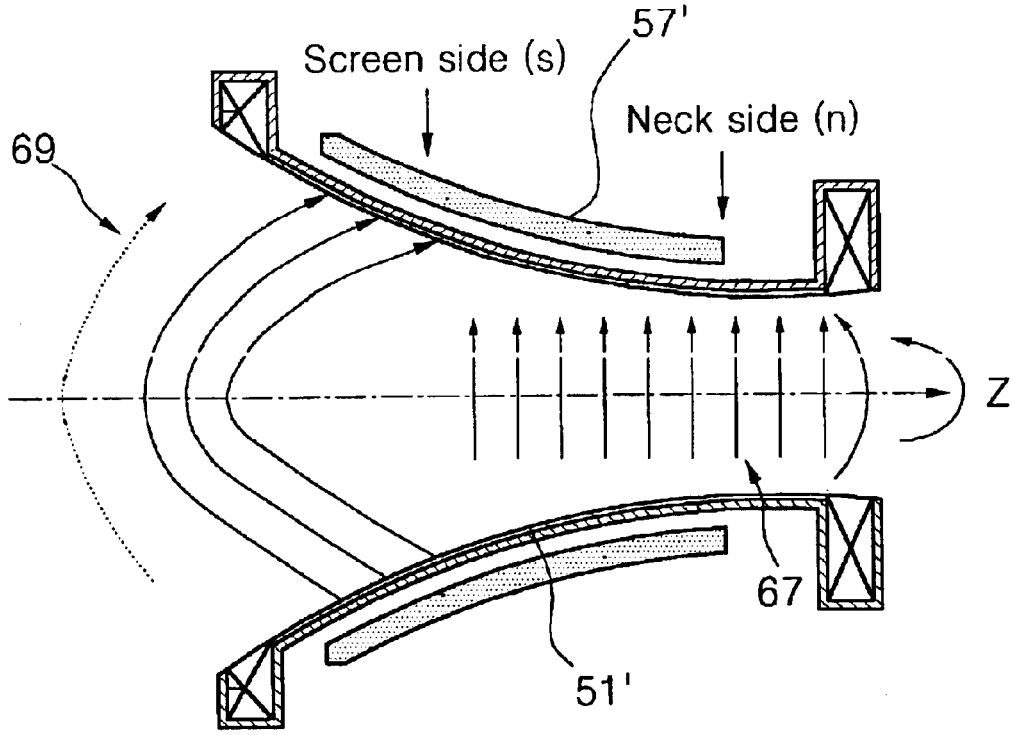

FIGS. 9A and 9B respectively illustrate leakage magnetic field patterns of the deflection yoke of the present invention and the conventional deflection yoke. FIG. 9A shows the leakage magnetic field patterns of the present invention, and FIG. 9B shows the conventional leakage magnetic field patterns.

As explained above, a leakage magnetic field 69 generated in the deflection yoke is sensitive to the diameter Rc and slope angle of the end of the ferrite core. Therefore, in the deflection yoke of the present invention, the diameter Rc of the end of the ferrite core to the screen side is 50% to 85% of the diameter Rh of the end of the horizontal deflection coil to the screen side, and the interval Ld between the end of the horizontal deflection coil to the screen side and the end of the ferrite core to the screen side is 27% to 50% of the length Lh of the horizontal deflection coil in the tub axis direction Z.

Accordingly, the leakage magnetic field (FIG. 9A) of the deflection yoke of the invention is decreased much more than the leakage magnetic field (FIG. 9B) of the conventional deflection yoke.

Still referring to FIGS. 9A and 9B, the leakage magnetic field 69 generated in the deflection yoke includes a leakage magnetic field of a main deflection magnetic field generated in the screen side and a leakage magnetic field of a main deflection field generated in the neck side. Here, the leakage magnetic field generated in the neck side is offset by a shield case mounted generally in the cathode ray tube. That is, the leakage magnetic field generated in the deflection yoke is transferred to the shield case, and the shield case offsets the leakage magnetic field by generating an inverse magnetic field. However, in the related art, the leakage magnetic field generated in the screen side must be reduced in the deflection yoke, or offset by using a special auxiliary means for offsetting the leakage magnetic field, namely the cancel coils.

The present invention decreases the diameter Rc of the end of the ferrite core to the screen side, and increases the interval Ld between the end of the horizontal deflection coil to the screen side and the end of the ferrite core to the screen side, thereby offsetting the leakage magnetic field generated in the screen side.

In general, the magnetic field is generated vertically to the inner surface of the ferrite core. Accordingly, when the diameter of the end of the ferrite core is decreased and the ferrite core becomes distant from the horizontal deflection coil as in the present invention, the leakage magnetic field can be sufficiently offset without using the cancel coils.

According to the experiment result, the ferrite core is designed so that the diameter Rc of the end of the ferrite core to the screen side can be 50% to 85% of the diameter of the end of the horizontal deflection coil to the screen side. When the diameter Rc of the end of the ferrite core to the screen side is below 50% of the diameter of the end of the horizontal deflection coil to the screen side, a beam strike neck (BSN) property is deteriorated. Conversely, when the diameter Rc of the end of the ferrite core to the screen side is greater than 85% of the diameter of the end of the horizontal deflection coil to the screen side, the leakage magnetic field is hard to decrease as in the related art.

In addition, the ferrite core is mounted on the deflection yoke so that the interval Ld between the end of the horizontal deflection coil to the screen side and the end of the ferrite core to the screen side can be 27% to 50% of the length Lh of the horizontal deflection coil in the tube axis direction Z.

When the interval Ld between the end of the horizontal deflection coil to the screen side and the end of the ferrite core to the screen side is below 27% of the length Lh of the horizontal deflection coil in the tube axis direction Z, the leakage magnetic field is difficult to decrease as in the related art. In the opposite case, the BSN property is deteriorated.

The deflection yoke of the invention can be applied to a transposed scan (TPS) type, which will now be explained in Embodiment 2.

Embodiment 2

Figure 10A:
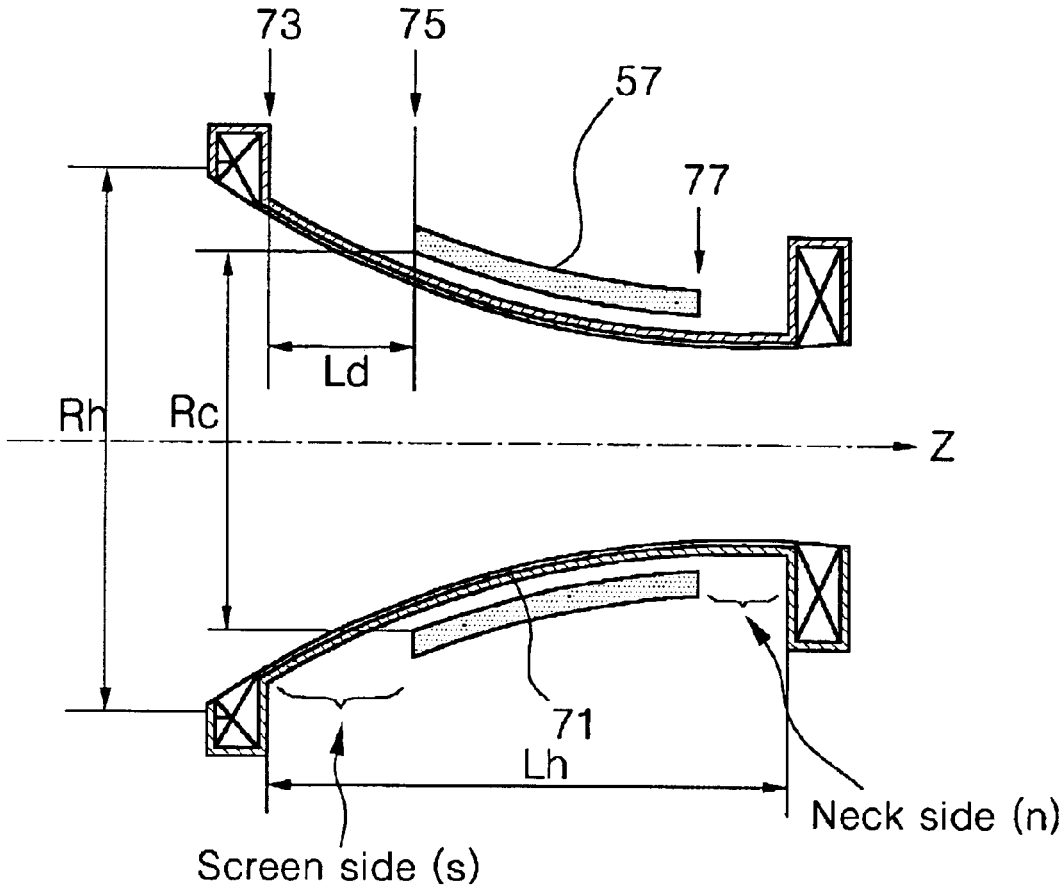
FIG. 10 is a view illustrating position relation between a ferrite core and a horizontal deflection coil in a deflection yoke using a transposed scan method in accordance with another preferred embodiment of the present invention.
Figure 10B:
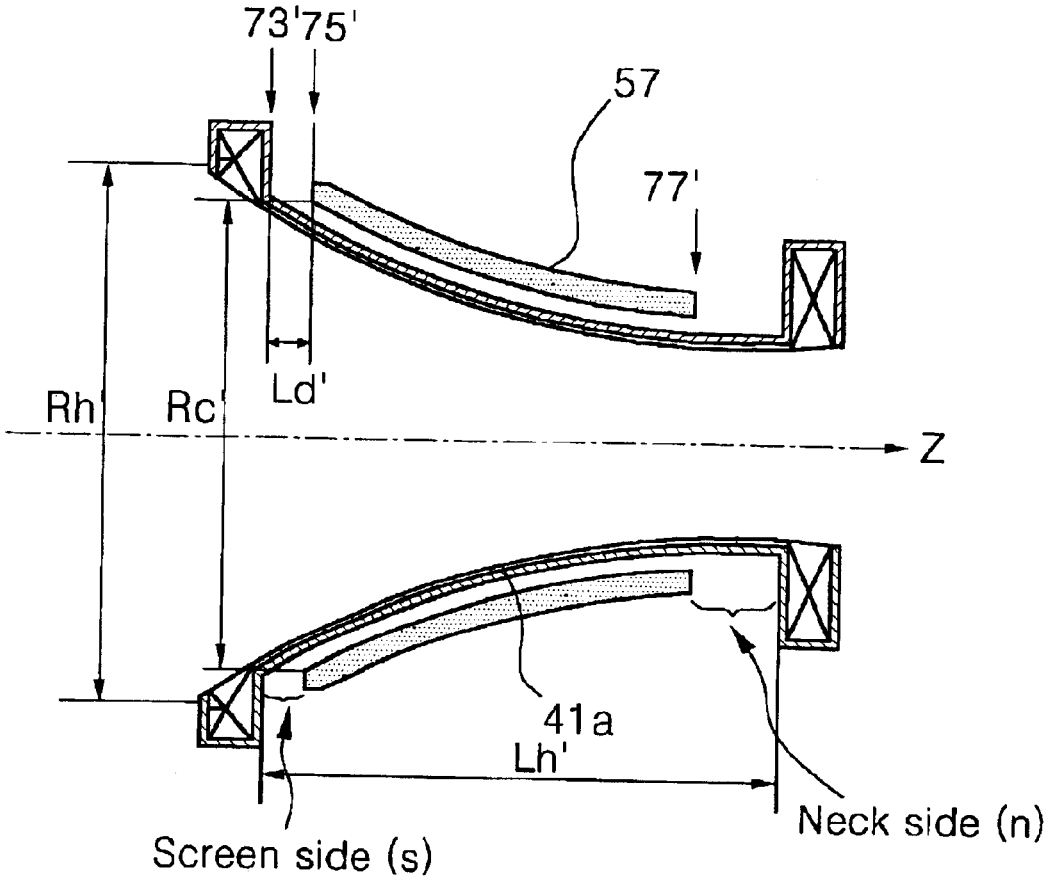

The position relation between a ferrite core and a horizontal deflection coil in the deflection yoke using the TPS is shown in the present invention (FIG. 10A) and the related art (FIG. 10B). The deflection yoke using the TPS has the same principle and concept as the deflection yoke of FIGS. 7A and 7B.

According to the scanning method for a general CRT, electron beams emitted from an electron gun, if seen from the screen, are scanned from the left side to the right side to configure a screen. However, according to the scanning method for TPS type CRT, electron beams emitted from an electron gun, if seen from the screen, are scanned from top to bottom or from bottom to top to configure a screen. In short, the scanning method for a TPS type CRT, unlike the conventional scanning method, scans the electron beams by rotating 90 degrees. Therefore, compared to the beam array of an electron gun for a general CRT, the beam array of the electron gun for TPS type CRT is set up in parallel to a perpendicular direction of a video screen, being rotated 90 degrees. As a result thereof, the deflection yoke is also rotated 90 degrees. That is, the horizontal deflection coil of FIG. 7A is positioned at the upper and lower sides of the funnel unit, and the vertical deflection coil is positioned at the right and left sides of the funnel unit. To prevent confusion of terminologies in the deflection yoke using the TPS, the horizontal deflection coil and vertical deflection coil of FIG. 7A are respectively designated as a line deflection coil and a frame deflection coil.

As depicted in FIG. 10A, the optimized allowable ranges of the diameter Rc of the end of the ferrite core to the screen side of the deflection yoke using the TPS and the interval Ld between the end of the line deflection coil to the screen side and the end of the ferrite core to the screen side are determined as described above.

That is, the diameter Rc of the end 75 of the ferrite core 57 to the screen side (s) is 50% to 85% of the diameter Rh of the end 73 of the line deflection coil 71 to the screen side (s), and the interval Ld between the end 73 of the line deflection coil 71 to the screen side (s) and the end 75 of the ferrite core 57 to the screen side (s) is 27% to 50% of the length Lh of the line deflection coil 71 in the tube axis direction Z.

The present invention can also be applied to a deflection yoke having a high deflection angle greater than 110°, which will now be explained in Embodiment 3.

Embodiment 3

The deflection yoke having a high deflection angle greater than 110° has the same principle and concept as the deflection yoke of FIGS. 7A and 7B.

That is, in the deflection yoke having a high deflection angle greater than 110°, the interval between the end of the horizontal deflection coil to the screen side and the end of the ferrite core to the screen side is 27% to 50% of the length Lh of the horizontal deflection coil in the tube axis direction, as shown in FIGS. 7A and 7B.

In addition, in the deflection yoke having a high deflection angle greater than 110°, the diameter Rc of the end of the ferrite core to the screen side is 50% to 85% of the diameter of the end of the horizontal deflection coil to the screen side.

The leakage magnetic field is measured below 20 nT by using the condition range as shown in Table 1.

TABLE 1

| Items | 120° deflection angle |
|---|---|
| Lh | 60 mm |
| Rh | 46 mm |
| Lc | 32 mm |
| Rc | 35 mm |
| Ld | 21 mm |
| Ld/Lh | 0.34 |
| Rc/Rh | 0.77 |

Here, Lh represents the length of the horizontal deflection coil in the tube axis direction, Rh represents the diameter of the end of the horizontal deflection coil to the screen side, Lc represents the length of the ferrite core in the tube axis direction, Rc represents the diameter of the end of the ferrite core to the screen side, and Ld represents the interval between the end of the horizontal deflection coil to the screen side and the end of the ferrite core to the screen side.

As discussed earlier, in accordance with the present invention, the cathode ray tube can efficiently decrease the leakage magnetic field without using general cancel coils. Accordingly, the present invention overcomes reduction of horizontal deflection sensitivity, deterioration of the heat generation property and increase of the component unit cost due to the general cancel coils.

Moreover, the cathode ray tube can remarkably decrease the leakage magnetic field below 20 nT in the deflection yoke having the high deflection angle greater than 110°. The cathode ray tube can also be applied to the TPS method to considerably increase the application range.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A cathode ray tube comprising a panel having a phosphor screen, a funnel connected to the rear surface of the panel, an electron gun emitting electron beams from the rear portion of the funnel, a horizontal deflection coil and a vertical deflection coil for deflecting the electron beams emitted from the electron gun in horizontal and vertical directions, and a deflection yoke including a ferrite core for improving magnetic efficiency by reducing a loss of a magnetic force of horizontal and vertical deflection magnetic fields generated in the horizontal deflection coil and the vertical deflection coil, wherein, in the deflection yoke, a diameter of an end of the ferrite core atto the screen side of the deflection yoke is 50% to 85% of a diameter of an end of the horizontal deflection coil atto the screen side of the deflection yoke.

2. A cathode ray tube comprising a panel having a phosphor screen, a funnel connected to the rear surface of the panel, an electron gun emitting electron beams from the rear portion of the funnel, a horizontal deflection coil and a vertical deflection coil for deflecting the electron beams emitted from the electron gun in horizontal and vertical directions, and a deflection yoke including a ferrite core for improving magnetic efficiency by reducing a loss of magnetic force of horizontal and vertical deflection magnetic fields generated in the horizontal deflection coil and the vertical deflection coil, a deflection angle of the cathode ray tube being greater than 110° and the leakage magnetic field of said deflection yoke being less than 20 nT, wherein, in the deflection yoke, an interval between an end of the horizontal deflection coil atto the screen side of the deflection yoke and an end of the ferrite core at said screen side is 27% to 50% of a length of the horizontal deflection coil in a tube axis direction.

3. The cathode ray tube according to claim 1, wherein, in the deflection yoke, an interval between the end of the horizontal deflection coil at said screen side and the end of the ferrite core at said screen side is 27% to 50% of the length of the horizontal deflection coil in the tube axis direction.

4. The cathode ray tube according to claim 1, wherein a deflection angle of the cathode ray tube is greater than 110°.

5. A transposed scan PS type cathode ray tube comprising a panel having a phosphor screen, a funnel connected to the rear surface of the panel, an electron gun emitting electron beams from the rear portion of the funnel, a line deflection coil and a frame deflection coil for deflecting the electron beams emitted from the electron gun in the horizontal and vertical directions, and a deflection yoke including a ferrite core for improving magnetic efficiency by reducing a loss of a magnetic force of horizontal and vertical deflection magnetic fields generated in the line deflection coil and the frame deflection coil, wherein, in the deflection yoke, a diameter of an end of the ferrite core atto the screen side of the deflection yoke is 50% to 85% of a diameter of an end of the line deflection coil at said screen side.

6. A transposed scan (TPS) type cathode ray tube comprising a panel having a phosphor screen, a funnel connected to the rear surface of the panel, an electron gun emitting electron beams from the rear portion of the funnel, a line deflection coil and a frame deflection coil for deflecting the electron beams emitted from the electron gun in the horizontal and vertical directions, and a deflection yoke including a ferrite core for improving magnetic efficiency by reducing a loss of a magnetic force of horizontal and vertical deflection magnetic fields generated in the line deflection coil and the frame deflection coil, a deflection angle of the cathode ray tube being greater than 110° and the leakage magnetic field of said deflection yoke being less than 20 nT, wherein, in the deflection yoke, an interval between an end of the line deflection coil atto the screen side of the deflection yoke and an end of the ferrite core to at said screen side is 27% to 50% of a length of the line deflection coil in a tube axis direction.

7. The cathode ray tube according to claim 5, wherein, in the deflection yoke, an interval between the end of the line deflection coil at said screen side and the end of the ferrite core at said screen side is 27% to 50% of the length of the line deflection coil in the tube axis direction.

8. The cathode ray tube according to claim 5, wherein a deflection angle of the cathode ray tube is greater than 110°.

9. The cathode ray tube according to claim 3, wherein a deflection angle of the cathode ray tube is greater than 110°.

10. The cathode ray tube according to claim 7, wherein a deflection angle of the cathode ray tube is greater than 110°.

* * * * *